United States Patent [19]

Gasser

[11] 4,288,934

[45] Sep. 15, 1981

[54] IRONING MANGLE

[75] Inventor: Rene Gasser, Wolfhausen, Switzerland

[73] Assignee: Maschinenfabrik Ad. Schulthess & Co. Aktiengesellschaft, Zurich, Switzerland

[21] Appl. No.: 85,755

[22] Filed: Oct. 17, 1979

[51] Int. Cl.[3] ..... D06F 61/00; D06F 63/00

[52] U.S. Cl. ..... 38/44; 38/55

[58] Field of Search ..... 38/6, 44–55

[56] References Cited

U.S. PATENT DOCUMENTS

| | | | |
|---|---|---|---|
| 515,996 | 3/1894 | Crawford | 38/6 X |
| 683,402 | 9/1901 | Hoyt | 38/6 X |
| 835,188 | 11/1906 | Gilmore | 38/6 X |

FOREIGN PATENT DOCUMENTS

| | | | |
|---|---|---|---|
| 962486 | 7/1964 | United Kingdom | 38/55 |

*Primary Examiner*—Louis Rimrodt

*Attorney, Agent, or Firm*—Lewis H. Eslinger

[57] ABSTRACT

An ironing mangle for pressing fabric includes a heating member or shoe which transfers heat to a fabric conveyed thereover. The heating member includes a concave surface which forms a substantially semi-cylindrical cut-out section over which the fabric is conveyed and at least one other surface over which the fabric is also conveyed for maximizing the heat transfer from the heating member to the fabric. The concave surface preferably includes two end edges which are arranged so that the angle between the plane connecting the end edges and a vertical plane passing through either of the end edges is in the range of 0° to 30°. The ironing mangle further includes a cylindrical pressing roller for applying pressure to the concave surface, in which the roller is adapted to rotate about its central axis in order to convey the fabric over the concave surface when applying pressure thereagainst.

15 Claims, 3 Drawing Figures

IRONING MANGLE

BACKGROUND OF THE INVENTION

This invention relates generally to ironing mangles and, more particularly, is directed to an improved ironing mangle of the type which utilizes a pressing roller for applying pressure to, while conveying fabric over, a heated body.

In known ironing mangles of the above type, such as in Swiss Pat. No. 359,679, various heating shoes or bodies are linearly arranged and a plurality of rollers are utilized to convey a fabric over the respective surfaces thereof while also pressing the fabric against these surfaces. However, such ironing mangles have proven to be extremely inefficient since the surface of each heated body on which the laundry is mangled comprises a small portion of the entire surface of the body. Consequently, high heat losses result in the utilization of such devices and the fabric is not always completely dry when removed therefrom. To compensate for such high heat losses, the prior art has attempted to insulate unused portions of each body. Unfortunately, this has also resulted in significantly higher costs.

Further, when such linearly arranged shoes are used, the removal of hot humid waste air from the ironing mangle becomes extremely difficult and inefficient, in addition to the intolerable working environment produced. For example, a large air-suction hood used to ventilate the hood must be extremely large, resulting in additional ventilating costs.

OBJECTS AND SUMMARY OF THE INVENTION

Accordingly, it is an object of this invention to provide an ironing mangle that avoids the above-described difficulties encountered with the prior art.

More particularly, it is an object of this invention to provide an ironing mangle in which the heating member or shoe includes at least one concave surface over which the fabric is conveyed and at least one other surface over which the fabric is also conveyed for maximizing the heat transfer from the heating member to the fabric.

Another object of this invention is to provide an ironing mangle in which substantially the entire surface of the heating member is used to heat a fabric conveyed thereover.

Still another object of this invention is to provide an ironing mangle in which heat losses may be kept to a minimum and the roller area maintained small.

Yet another object of this invention is to provide an ironing mangle which includes a concave surface having two end edges in which the angle between the plane joining the end edges and a vertical plane passing through either of the end edges is in the range of 0° to 30°.

In accordance with an aspect of this invention, an ironing mangle includes a heating member for transferring heat to a fabric which is conveyed thereover, the heating member including a concave surface and at least one other surface over which the fabric is conveyed for maximizing the heat transfer from the heating member to the fabric, and a pressing member for applying pressure to the concave surface when the fabric is conveyed thereover.

In a preferred embodiment, the concave surface forms a substantially semi-cylindrical cut-out section and has two end edges which are arranged such that the angle between the plane connecting the end edges and a vertical plane passing through either of the end edges is in the range of 0° to 30° when the heating member is disposed in a vertical configuration.

The above, and other, objects, features and advantages of the invention, will be apparent in the following detailed description of illustrative embodiments of the invention which is to be read in connection with the accompanying drawings.

DETAILED DESCRIPTION OF THE PREFERRED EMBODIMENTS

Figure 1:
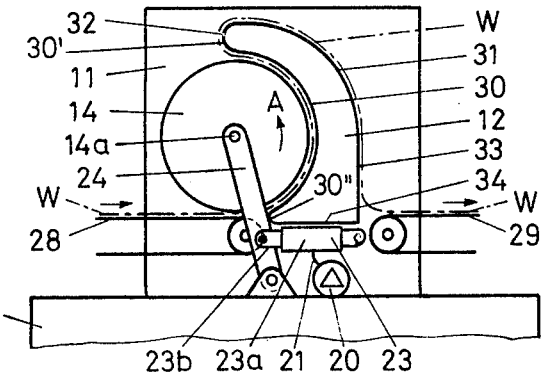
FIG. 1 is a schematic, side plan view illustrating an ironing mangle according to a first embodiment of this invention.

Referring to the drawings in detail, and initially to FIG. 1 thereof, it will be seen that, in a first embodiment of an ironing mangle according to this invention, there is provided a machine base or frame 10, a housing 11, a heating shoe 12 for transferring heat to a fabric conveyed thereover and a pressing roller 14 for applying pressure to shoe 12 when fabric is conveyed thereover. Shoe 12 is shown to include a substantially flat horizontal support surface 34 which rests upon a suitable support (not shown) on base 10 or housing 11. Shoe 12 is formed into an arcuate configuration having a first concave surface or trough 30 extending from a first edge of support surface 34 and which forms a semi-cylindrical cut-out section. Trough 30 includes upper and lower end edges 30' and 30'' with upper edge 30' overhanging lower edge 30'', the latter being connected to support surface 34. In this manner, the angle between the plane connecting the two end edges 30' and 30'' and a vertical plane passing through either end edge is in the range of 0° to 30°, with a preferred angular displacement of 15°. This aspect of the invention will be described later in regard to roller 14.

Shoe 12 further includes a semi-circular surface 32 connected to the upper edge 30' of concave surface 30, a quarter-circular outer surface 31 connected to semi-circular surface 32 and a substantially planar surface 33 connecting outer surface 31 to the opposite end edge of support surface 34. A conventional heating source (not shown) is provided in shoe 12 for heating surfaces 30–33 thereof.

In known ironing mangles, the fabric is only conveyed over a single surface of shoe 12, such as, concave surface 30, where it is heated and pressed, In the present invention, by arranging shoe 12 in the vertical configuration of FIG. 1 and conveying the fabric over surfaces 30–33 along dashed path W, substantially the entire surface area of shoe 12 is utilized. This results in an extremely efficient transfer to heat and a complete drying of the fabric. Thus, the only surface of shoe 12 that is not utilized to heat the fabric is support surface 34 which supports shoe 12. It is to be realized that, although not shown, any suitable means can be used to convey the fabric about surfaces 31–33, such as rollers or the like. Thus, it is readily seen that, in comparison with prior art devices, substantially the entire surface area of shoe 12 is exposed to enable fabric to be conveyed thereover for maximizing the heat transfer from shoe 12 to the fabric.

The ironing mangle according to this invention further includes pressing roller 14 for applying pressure to concave surface or trough 30 when fabric is conveyed thereover. Pressing roller 14 is of a cylindrical configuration and includes a central axis 14*a* about which roller 14 is adapted to rotate, by any conventional means, in the direction of arrow A. For example, a drive motor and belt may be utilized, along with step-up or step-down gearing, to drive roller 14. Such drive apparatus (not shown) may be provided, for example, in housing 11. As shown in FIG. 1, the cylindrical configuration of roller 14 substantially corresponds to that of concave surface 30 so that, when fabric is received at concave surface 30, roller 14 acts to press this fabric against concave surface 30 and to also convey the fabric thereover from lower end edge 30″ to upper end edge 30′.

The ironing mangle further includes means for pressing roller 14 towards concave surface 30, which means is well known in the art and may include a connecting lever 24 which is pivotally connected to base 10 at one end thereof and at the other end, pivotally connected to roller 14 at the central axis 14*a* thereof. A piston actuable device 23 is provided, including a cylinder 23*a* and piston 23*b* slidably disposed therein in which the free end of piston 23*b* is pivotally connected to connecting lever 24 intermediate the two ends thereof. As shown in FIG. 1, the amount of horizontal displacement of piston 23*b* is controlled by a pressure generator 20 connected to cylinder 23*a* by pressure line 21. In this manner, when piston 23*b* is actuated to be displaced towards the right in FIG. 1, connecting lever 24 is rotated about its base pivot pin in the clockwise direction to urge roller 14 towards concave surface 30 for applying pressure to any fabric situated between roller 14 and concave surface 30 and to also convey this fabric over concave surface 30. That is, since roller 14 is rotated about its central axis 14*a*, roller 14 also acts to convey the fabric over concave surface or trough 30. When connecting lever 24 is rotated in the counter-clockwise direction of FIG. 1 by means of piston 23*b*, roller 14 is disengaged from concave surface 30 and, because of the angular arrangement of the plane connecting end edges 34′ and 34″ of concave surface 30, shoe 12 is then free to be removed from the ironing mangle. It is thus seen that roller 14 is not supported by shoe 12 and is adapted to drop out of trough 30 once the pressure applied to it by piston 23*b* is removed. Further, although piston-actuable device 23 has been shown as a pressure-actuated device, it is readily apparent that only other suitable device, such as an electrically operated solenoid may be used in its place.

A conveyor system comprised of conveyor belts 28 and 29 are also provided for conveying the fabric to and from shoe 12, respectively. In this manner, fabric from conveyor 28 follows the dashed path W along conveyor 28, concave surface 30, surface 32, outer surface 31, planar surface 33 and is removed from shoe 12 by conveyor belt 29. As such, substantially the entire surface of shoe 12 is utilized to heat the fabric in comparison with known ironing mangles which merely remove the fabric at upper end edge 30′, resulting in substantial heat losses.

Figure 2:
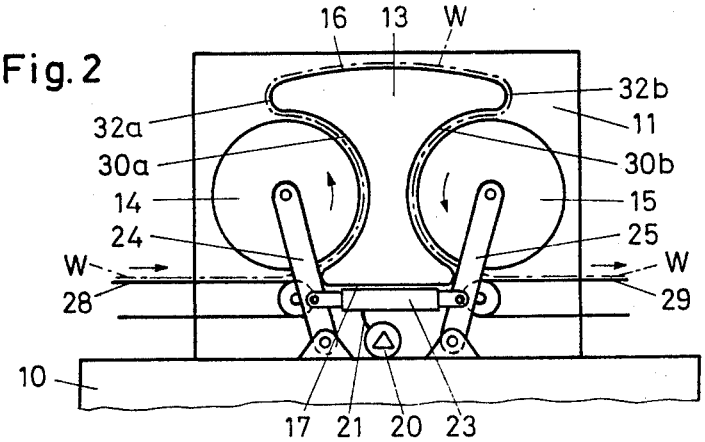
FIG. 2 is a schematic, side plan view of a second embodiment of an ironing mangle according to this invention.

Referring now to FIG. 2, it will be seen that, in an ironing mangle according to a second embodiment of this invention, elements corresponding to those described above with reference to the first embodiment of FIG. 1 are identified by the same reference numerals. In the ironing mangle of FIG. 2, shoe 13 is formed with a horizontal support surface 17 for supporting the shoe and two concave surfaces 30*a* and 30*b* extending in the vertical direction from opposing edges of support surface 17. Both concave surfaces 30*a* and 30*b* are identical to concave surface 30 of FIG. 1. A curved surface 16 is connected to the upper edges of concave surfaces 30*a* and 30*b* by semi-circular surfaces 32*a* and 32*b*, respectively. In addition to roller 14, which is associated with concave surface 30*a*, a second roller 15 is provided which is associated with concave surface 30*b*, both rollers operating in a manner identical to roller 14 in FIG. 1. Connecting levers 24 and 25 pivotally connect rollers 14 and 15 at their central axes, respectively, to base 10, and connecting levers 24 and 25 are connected together by piston-actuable device 23 which is now provided with oppositely directed pistons pivotally attached to connecting levers 24 and 25, respectively, intermediate their ends. Rollers 14 and 15 are rotated in the same direction, as shown in FIG. 2, such that the fabric is conveyed by conveyor 28 to shoe 13, whereupon roller 14 conveys the fabric around concave surface 30*a*. Conventional means, such as rollers or the like, as previously described, further convey the fabric around surfaces 32*a*, 16 and 32*b*, whereupon roller 15 further conveys the fabric around concave surface 30*b* onto conveyor 29. Again, it is thus seen that substantially the entire surface area of shoe 13, except for supporting surface 17, is used to transfer heat to the fabric.

Figure 3:
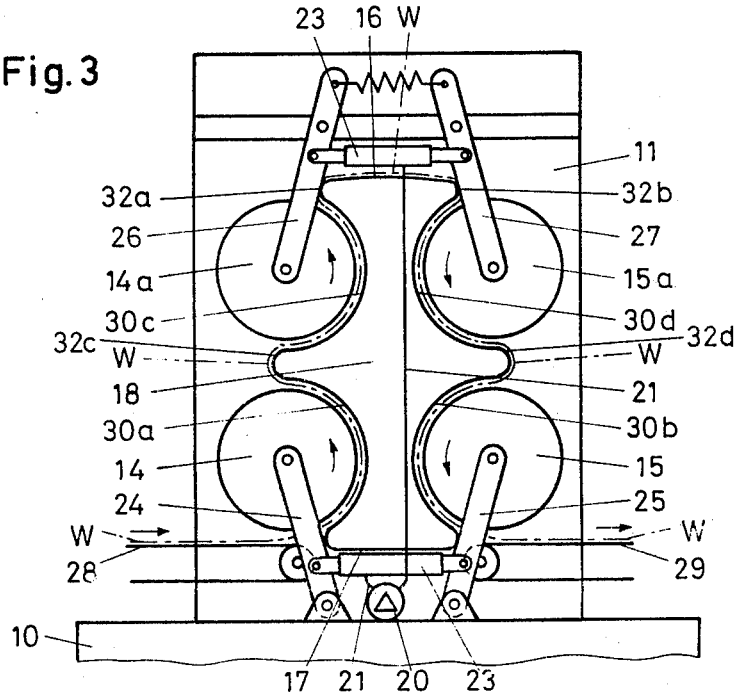
FIG. 3 is a schematic, side plan view of a third embodiment of an ironing mangle according to this invention.

Referring now to FIG. 3, wherein like numerals represent like parts, it is seen that shoe 18 is a double mirror image of shoe 13 of FIG. 2. Thus, the fabric travels along path W from conveyor 28, over concave surface 30*a* by means of roller 14, over surface 32*c*, over concave surface 30*c* by means of roller 14*a*, over surface 32*a*, 16 and 32*b*, over concave surface 30*d* by means of roller 15*a*, over surface 32*d*, over concave surface 30*b* by means of roller 15 and onto conveyor belt 29, such that substantially the entire surface area of shoe 18 is used to heat the fabric.

It is to be recognized that, in all of the above embodiments, the fabric is conveyed along dashed path W so as to be heated by substantially the entire surface area of shoe 12, 13 or 18, with the exception of supporting surfaces 34 (FIG. 1) and 17 (FIGS. 2 and 3). As such, for all practical purposes, substantially no heat is lost and, almost the entire heat supplied to the shoe is used to dry the fabric. Further, due to the fact that the shoes, and consequently, the troughs, are arranged in a substantially upright or vertical configuration, the space required for a multi-roller mangle is greatly decreased. Because of such compact arrangement, an air-suction hood used to ventilate the room containing the mangle may be decreased to roughly one-half the area otherwise required by a plurality of shoes.

It is apparent that many modifications can be made within the scope of this invention. For example, in known ironing mangles, the fabric is typically removed at the upper edge 30′ of concave surface 30 (FIG. 1). In this manner, it is advantageous to supply and remove the fabric from the front of the device. Although not shown in the present apparatus, it is apparent that a suitable modification, within the scope of this invention, can be provided such that conveyor belt 29 returns the fabric to the front of the device, such as beneath conveyor belt 28. As a further example, in FIG. 2, a third concave surface can be provided along surface 16 with a third roller associated therewith.

Having described specific preferred embodiments of the invention with reference to the accompanying drawings, it is to be understood that the invention is not limited to these precise embodiments, and that various changes and modifications may be effected therein by one skilled in the art without departing from the scope or spirit of the invention as defined in the appended claims.

What is claimed is:

1. An ironing mangle, comprising:

a heating member for transferring heat to a fabric which is conveyed thereover, said heating member being disposed in a vertical configuration and including a concave surface having two end edges and which forms a substantially semi-cylindrical cut-out section, and at least one other surface over which said fabric is conveyed for maximizing the heat transfer from said heating member to said fabric; and a pressing member for applying pressure to said concave surface, in response to a force applied thereto, when said fabric is conveyed thereover, wherein said two end edges are arranged so that the angle between the plane connecting said end edges and a vertical plane passing through either of said end edges is in the range of 0° to 30° so that the force of gravity acts to disengage said pressing member from said concave surface when said force applied to said pressing member is removed.

2. An ironing mangle according to claim 1; in which said pressing member is of a cylindrical configuration corresponding to said concave surface and has a central axis about which it is adapted to be rotated to convey said fabric over said concave surface.

3. An ironing mangle according to claim 2; further including means for controlling the pressure applied by said pressing member to said concave surface.

4. An ironing mangle according to claim 3; in which said means for controlling includes a piston-actuable means connected to said pressing member at the central axis thereof.

5. An ironing mangle according to claim 4; further including a frame and a connecting lever pivotally connecting said pressing member at the central axis thereof to said frame and in which said piston-actuable means includes a cylinder and a piston slideably disposed therein and pivotally connected to said connecting lever.

6. An ironing mangle according to claim 5; in which said connecting lever includes two end portions which are pivotally connected to said frame and said pressing member at the central axis thereof, respectively, and said piston is pivotally connected to said connecting lever intermediate said two end portions thereof.

7. An ironing mangle according to claim 1; in which said angle is substantially 15°.

8. An ironing mangle according to claim 1; in which said at least one other surface includes a curved outer surface over which said fabric is further conveyed for maximizing the heat transfer from said heating member to said fabric.

9. An ironing mangle according to claim 1; further including means for conveying said fabric to and from said heating member.

10. An ironing mangle according to claim 1; in which said heating member includes a support surface for supporting said heating member in said vertical configuration and being connected to one of said end edges of said concave surface, a quarter-circular outer surface having a radius approximately equal to the radius of the concave surface and connected at one end thereof to the other end edge of the concave surface, and a substantially planar surface connected between the quarter-circular outer surface and the support surface.

11. An ironing mangle, comprising:

a heating member for transferring heat to a fabric which is conveyed thereover, said heating member being disposed in a vertical configuration and including a plurality of concave surfaces over which said fabric is conveyed for maximizing the heat transfer from said heating member to said fabric, each concave surface forming a substantially semi-cylindrical cut-out section and having two end edges; and a plurality of pressing members associated with respective ones of said concave surfaces for applying pressure thereto, in response to a force applied to said pressing members, when said fabric is conveyed thereover, wherein said two end edges of each concave surface are arranged so that the angle between the plane connecting said end edges and a vertical plane passing through either of said end edges is in the range of 0° to 30° so that the force of gravity acts to disengage at least one said pressing member from said concave surface when the force applied to said at least one pressing member is removed.

12. An ironing mangle according to claim 11; in which said heating member includes two concave surfaces on opposite sides thereof and said plurality of pressing members includes two pressing members, each associated with a respective one of said concave surfaces for applying pressure thereto when said fabric is conveyed thereover.

13. An ironing mangle according to claim 12; in which said two concave surfaces are symmetrically disposed on opposite sides of said heating member and face outwardly from said heating member, and said heating member includes a support surface connected between first ones of said end edges of said two concave surfaces and a connecting surface connected between the other end edges of said two concave surfaces.

14. An ironing mangle according to claim 11; in which said heating member includes four concave surfaces symmetrically arranged such that two opposing sides of said heating member include two concave surfaces serially arranged in a vertical configuration.

15. An ironing mangle according to claim 14; in which said plurality of pressing members includes four pressing members, each associated with a respective one of said concave surfaces for applying pressure thereto when said fabric is conveyed thereover; each of said concave surfaces faces outwardly from said heating member; and said heating member further includes two nose-like convex portions connecting the serially arranged concave surfaces on each of the opposing sides of said heating member, a support surface connecting a first two of said concave surfaces on opposing sides of said heating member, and a connecting surface connecting the other two of said concave surfaces on opposing sides of said heating member.

* * * * *